United States Patent [19]

Miyaoka

[11] Patent Number: 5,005,466

[45] Date of Patent: Apr. 9, 1991

[54] CAVITATION-PREVENTING PILOT VALVE CONTROL SYSTEM FOR POWER SHOVEL HYDRAULIC CIRCUIT

[75] Inventor: Satoshi Miyaoka, Hiroshima, Japan

[73] Assignee: Kabushiki Kaisha Kobe Seiko Sho, Kobe, Japan

[21] Appl. No.: 326,017

[22] Filed: Mar. 20, 1989

[30] Foreign Application Priority Data

Apr. 7, 1988 [JP] Japan ..... 63-86500

[51] Int. Cl.[5] ..... F15B 11/04; F15B 13/043

[52] U.S. Cl. ..... 91/420; 91/461

[58] Field of Search ..... 91/420, 426, 461; 60/460–462; 137/625.66

[56] References Cited

U.S. PATENT DOCUMENTS

| | | | |
|---|---|---|---|
| 3,630,121 | 12/1971 | Landaeus et al. | 91/437 |
| 4,185,660 | 1/1980 | Faix | 137/625.66 X |
| 4,411,189 | 10/1983 | Miller | 91/420 |
| 4,700,610 | 10/1987 | Bauer et al. | 91/420 X |
| 4,718,329 | 1/1988 | Nakajima et al. | 91/459 X |
| 4,747,335 | 5/1988 | Budzich | 91/361 |
| 4,757,685 | 7/1988 | Burckhartzmeyer | 60/452 |
| 4,840,111 | 6/1989 | Garnjost | 91/459 X |

FOREIGN PATENT DOCUMENTS

| | | |
|---|---|---|
| 0228707 | 7/1987 | European Pat. Off. . |
| 142003 | 8/1983 | Japan . |
| 193906 | 11/1983 | Japan . |
| 34009 | 2/1984 | Japan . |
| 75135 | 4/1986 | Japan . |
| 919714 | 2/1963 | United Kingdom . |

*Primary Examiner*—Edward K. Look
*Assistant Examiner*—George Kapsalas
*Attorney, Agent, or Firm*—Oblon, Spivak, McClelland, Maier & Neustadt

[57] ABSTRACT

A hydraulic circuit suitable for use in a hydraulic operating circuit of a power shovel includes a hydraulic cylinder for driving a working component and a hydraulic change-over valve for selectively supplying the cylinder with a discharge oil pressure of a hydraulic pump driven from an engine. The hydraulic circuit prevents cavitation in an oil chamber of the cylinder and includes a pair of first signal receiving portions provided in the hydraulic change-over valve for moving the spool thereof in the forward and reverse directions away from a neutral position, respectively, and a second signal receiving portion for pulling back the spool toward said neutral position; a pressure detector produces a signal commensurate with the pressure in an oil chamber of the cylinder opposing an oil chamber where vacuum pressure is developed by the weight of the working component and a signalling device produces a signal indicating the extent of pulling back the spool toward the neutral position on receipt of the results of detection by the pressure detector, thereby supplying the signal to the second signal receiving portion of the hydraulic change-over valve.

6 Claims, 4 Drawing Sheets

CAVITATION-PREVENTING PILOT VALVE CONTROL SYSTEM FOR POWER SHOVEL HYDRAULIC CIRCUIT

BACKGROUND OF THE INVENTION

1. Field of the Invention

This invention relates to a hydraulic circuit which improves maneuverability particularly of operation of working components of a hydraulic power shovel.

2. Related Art

As shown in FIG. 4, a hydraulic power shovel generally includes, as working members, a boom 2 with its base end pivotally supported on a main body 1, an arm 3 with its base end pivotally supported on the fore end of the boom 2, and a working tool like a bucket 4 pivotally supported at the fore end of the arm 3, turning them respectively by a boom cylinder 5, an arm cylinder 6 and a bucket cylinder 7 for performing various jobs. However, depending upon the position and posture, the weights of these working members impose rotational moments on the respective cylinders 5 to 6, forcibly extending or contracting the latter and causing the phenomenon of so-called "cavitation", i.e., creation of a vacuum state due to an outflow of oil preceding an inflow to an oil chamber on the rod- or head-side of each cylinder. The cylinders in such condition become insensible to the above-mentioned dead weights, and, even if the oil pressure is succeedingly supplied to the oil chamber, remain inoperative until the cavity or void space created by the cavitation is filled with the supplied oil. As soon as the cavity is filled, the cylinder commences operation in an abrupt manner.

These situations are explained more particularly in connection with an operation of turning the arm 3 in the direction of arrow C in FIG. 5. With regard to the cylinder 6 for the arm, it receives the rotational moment imposed by the weights of the arm 3, bucket 4, cylinder 4 and other associated parts, imposing a stretching force until the overall center of gravity G indicated by an imaginary line comes onto a vertical line y—y passing through the pivotal point of the arm 3. Accordingly, as soon as a hydraulic change-over valve 35 is shifted to position B to supply the discharge oil pressure of a hydraulic pump 8 to a head-side oil chamber **6*a* of a cylinder 6 through a conduit 20, the pressurized oil in the rod-side oil chamber 6*b* is suddenly returned to a tank 21 through conduit 19 and oil passage through the hydraulic change-over valve 35 in position B. At this time, the supply of the pressurized oil to the head-side oil chamber 6*a* becomes small creating a vacuum cavity in the oil chamber. Consequently, even if extension of the cylinder 6 were continued to bring the overall center of gravity G beyond the vertical line y—y, the arm 3 would not operate until the cavity in the head-side oil chamber 6*a* is filled with the supplied oil pressure, the arm 3** being put in action abruptly as soon the cavity is filled.

As one can infer from FIG. 4, this phenomenon takes place not only on the vertical line y—y but also when extending the cylinders 6 and 7 from a contracted stated until the bladed end of the bucket 4 touches an object to be worked and, while continuing their extension, contracting the cylinder 5 further after contracting same until the bladed end of the bucket 4 touches the working object.

With a view to suppressing such phenomenon, the prior art proposes to provide, in the conduit 19 of FIG. 5, a slow return valve 34 which consists of a check valve and a fixed throttle valve with a throttle effect commensurate with the dead weights, the throttle valve imparting a resistance to the flow of oil which is returned from the rod-side oil chamber **6*b* when the arm cylinder 6 is extended, for slowing down its operating speed. Alternatively, combination relief valves 11 and 12, consisting of an overload relief valve and a check valve, are provided in conduits branched off the conduits 19 and 20, communicating the conduits 19 and 20 with a tank 21** through the check valve to prevent the cavitation.

The throttle valve which constitutes the slow return valve 34 of the prior art has no effect of preventing cavitation when its throttle effect is too low. On the other hand, when its throttle effect is too high, the operating speed of the cylinder becomes slower and unnecessary load is generated. Therefore, where adaptability to ordinary operations is concerned, it has been the general practice to make arrangements such that the cavitation would not occur to the cylinder in any marked degree at a discharge oil pressure of 60%–70% of the rated rotational speed of the engine which drives the hydraulic pump. However, recently hydraulic power shovels have been used not only for earthmoving operations in general but also for work requiring more meticulous skills like underground burying works, and it is sometimes required to replace the boom, arm and bucket to change their sizes or to set special working equipment in place of the bucket. Consequently, there have been operations where the engine speed is maintained at a low level or the load pressure on the cylinder is increased, which is difficult to cope with by the slow return valve 34 alone. Besides, as the cylinders 6 to 8 are located in positions remote from the tank 21, and the oil is taken up by the cavities in the cylinders through the lengthy conduits and check valve, the functions of the conventional combination valves 11 and 12 are often found insufficient.

SUMMARY OF THE INVENTION

In order to solve the above-mentioned problems, the hydraulic circuit of the present invention is provided with the following means.

(a) A signal receiving portion for returning the spool of the hydraulic change-over valve to its neutral position against a force tending to move the spool away from the neutral position in the forward or reverse direction;

(b) A detector or sensor means for detecting the pressure in or the cause of developing vacuum in the oil chamber which opposes the oil chamber where the load pressure is generated by the weights of the working components;

(c) A producing means for producing a signal for returning the spool of the hydraulic change-over valve toward its neutral position in response to the results of detection by the detector means; and (d) Signal supplying means for transmitting the output of the signal producing means to the signal receiving portion of the hydraulic change-over valve.

In order to prevent development of vacuum in the oil chamber of the cylinder, which opposes the oil chamber where the load pressure is generated by the weights of working components, even when the working components are changed into units of different weights or even when the working components are used in different postures or under different conditions, the detector means directly detects the pressure in the oil pressure in question or the indirect factor which tends to develop vacuum in the oil chamber, giving its output to the signal producing means thereby to return the spool of the hydraulic change-over valve toward its neutral position. Therefore, the pressurized oil which flows out of the oil chamber of the cylinder, in which the load pressure is developed, is resisted by the hydraulic change-over valve to prevent cavitation which might otherwise occur to the other oil chamber at the opposite end of the cylinder. Accordingly, the operation can be carried out safely without sudden stops or actions of the working components irrespective of the types or working postures of the working components or under any operating condition.

The above and other objects, features and advantages of the invention will become apparent from the following description and the appended claims, taken in conjunction with the accompanying drawings which show by way of example preferred embodiments of the invention.

DESCRIPTION OF PREFERRED EMBODIMENTS

Figure 1:
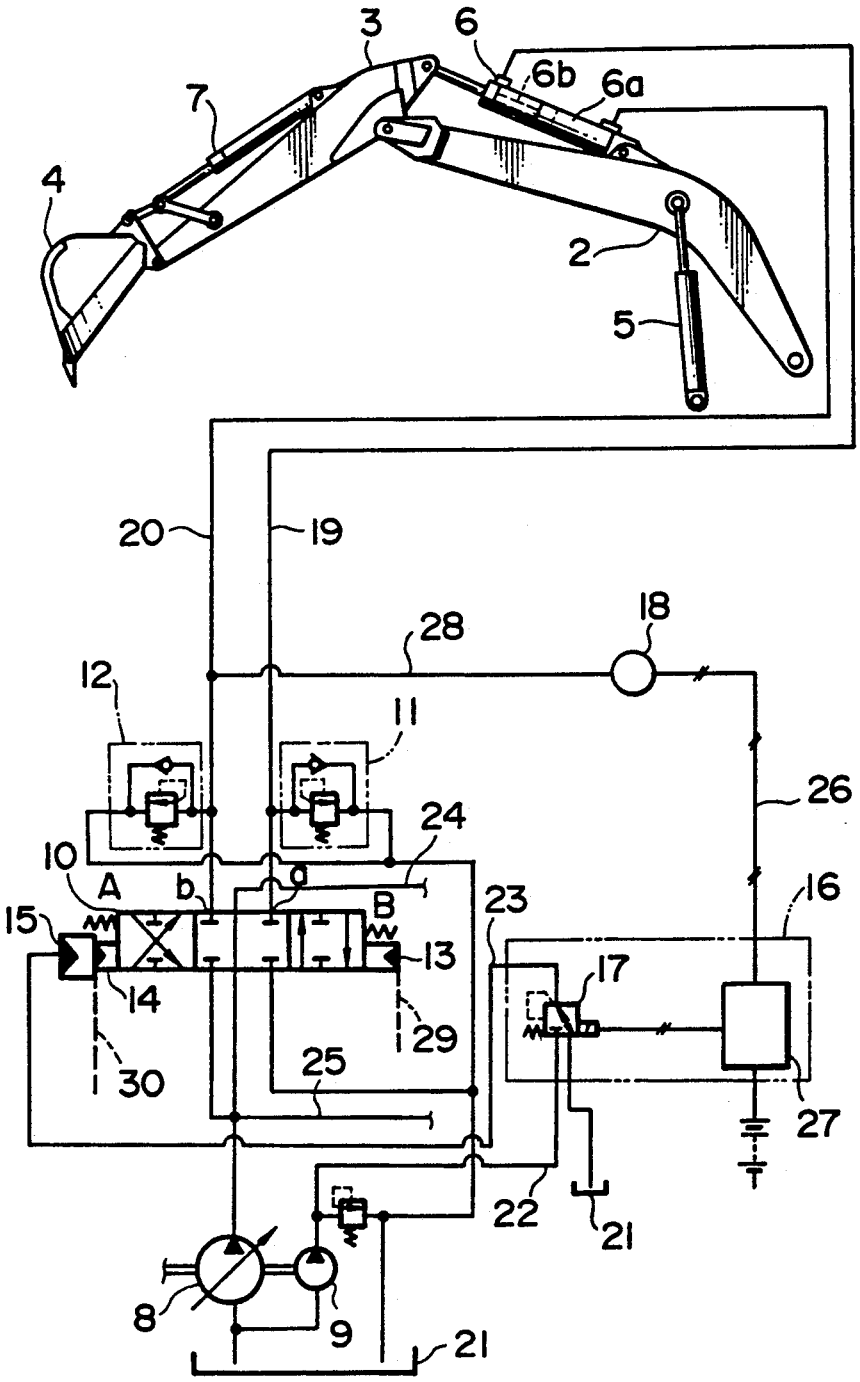
FIG. 1 is a diagrammatic illustration of the electro-hydraulic system in a first embodiment of the invention.

The invention is described more particularly by way of the embodiments shown in the drawing, applying the invention to the arm cylinder of a hydraulic power shovel.

Figure 5:
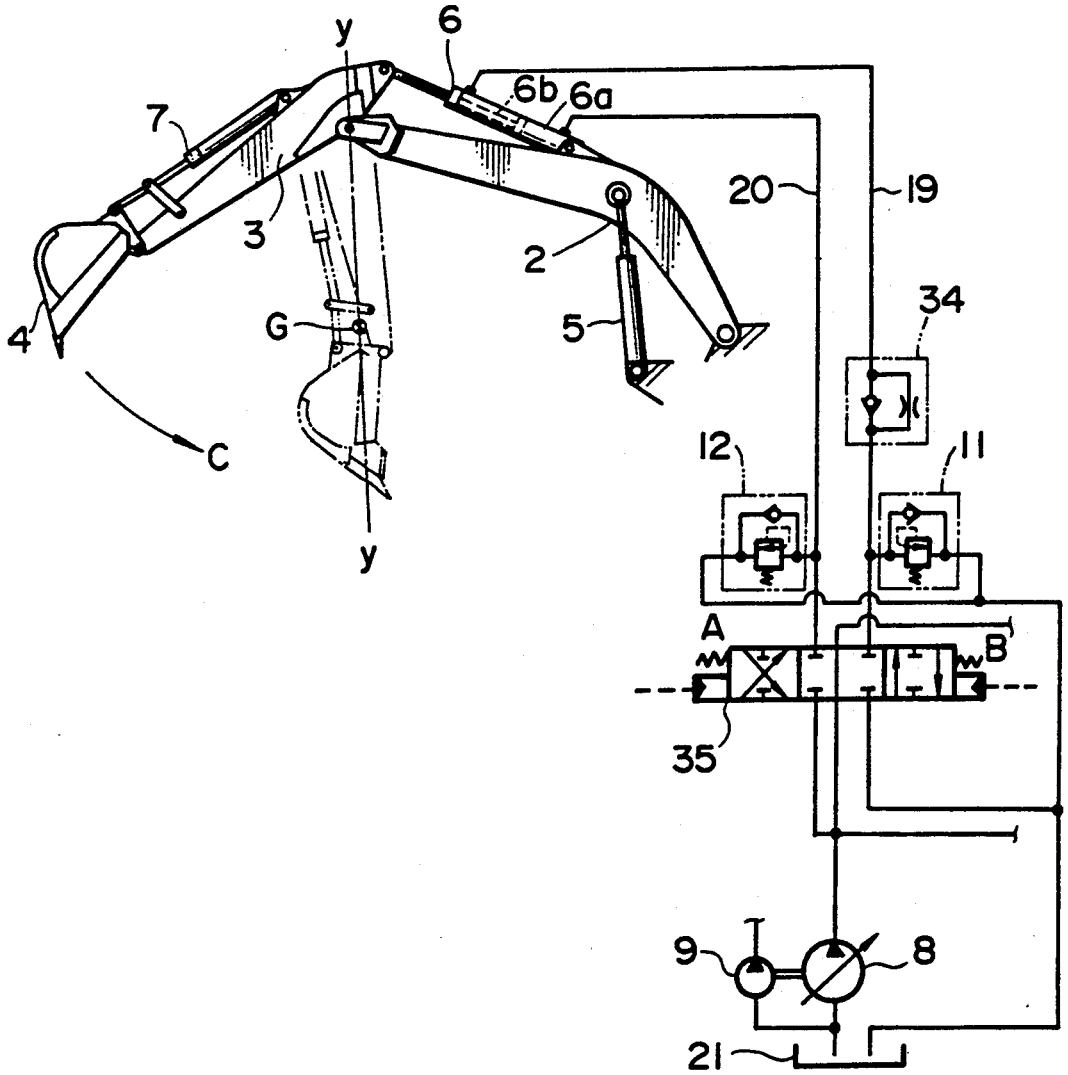
FIG. 5 PRIOR ART
FIG. 5 is a diagrammatic illustration showing major components of the conventional hydraulic power shovel.

Referring to FIG. 1, there are shown major components in the electro-hydraulic circuit in the first embodiment of the invention, in which the component parts common to FIG. 5 are designated by common reference numerals.

Denoted at 10 is a hydraulic change-over valve which is switchable to supply the discharge oil pressure of a hydraulic pump 8 to a cylinder 6, at 13 and 14 are first pilot oil chambers for operating the hydraulic change-over valve 10, the oil chamber 13 receiving a pilot pressure from an operating remote control valve (not shown) through conduit 29 to shift the spool of the hydraulic valve 10 to position B while the oil chamber 14 receiving a pilot pressure through conduit 30 to shift the spool to position A. The hydraulic change-over valve 10 is further provided with a second pilot oil chamber 15 which receives a pilot pressure through conduit 23 to push back the spool, which has been shifted to position B, toward the neutral position depending upon the level of the pilot pressure.

Figure 3:
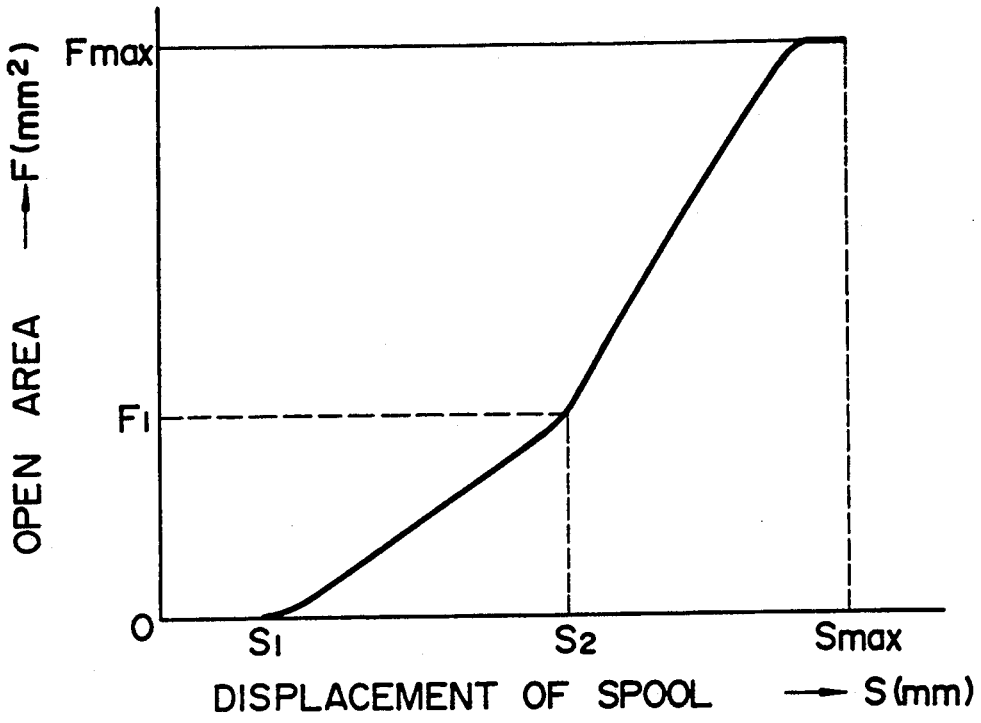
FIG. 3 is a diagram of the spool displacement versus the open area of the hydraulic change-over valve.

The hydraulic change-over valve 10 switches the oil passages in the same manner as in the prior art. Namely, the spool which is retained in a neutral position by a center spring is moved in the forward or reverse direction to shift the same into position A or B against the action of the spring, supplying the discharge oil pressure of the hydraulic pump 8 to port a in communication with the conduit 19 or to port b in communication with the conduit 20 while communicating the other port with the tank 21. At this time, by the combination of a notched groove and a reduced diameter portion on the spool and an annular groove on the hydraulic change-over valve casing, the open area of the internal passage is increased to a maximum value in relation with the degree of displacement of the spool. FIG. 3 shows the relationship between the displacement S of the spool and the open area F of a typical hydraulic change-over valve. As seen therefrom, the open area gradually increases from 0 to $F_1$ as the spool is displaced from $S_1$ to $S_2$, and then to $F_{max}$ as the displacement goes beyond $S_2$ and reaches $S_{max}$. In this instance, when the pilot pressure is applied to the above-mentioned pilot oil chamber 15, the spool is displaced back from $S_{max}$ toward $S_2$ and $S_1$.

Designated at 16 is a signalling means which is constituted by an electromagnetic proportional pressure regulator valve 17 and an arithmetic device 27, and at 18 is a pressure detector which measures the pressure in conduit 20 through conduit 28 and supplies its output to wire 26. In proportion to the signal acting on its signal receiving portion, the electromagnetic pressure regulator valve 17 is a signal supplying means and regulates the discharge oil pressure of the pilot pump 9 led through the conduit 22 and produces a pressure signal in the conduit 23, while the arithmetic device 27 is a signal supplying means which receives the signal from the pressure detector 18 and produces a signal for reducing the displacement of the spool of the hydraulic change-over valve 10 switched to the position B, from $S_{max}$ toward $S_2$ and $S_1$ of FIG. 3, on receipt of a signal indicating lowness of the pressure in the conduit 20.

Indicated at 24 and 25 are conduits which serve to supply the discharge oil pressure of the hydraulic pump 8 to another hydraulic change-over valve, tank 21 or other components through the hydraulic change-over valve 10 in the neutral position and the conduit 24, or to another hydraulic change-over valve through the conduit 25 in a parallel fashion, depending upon the arrangements and kinds of the components adopted in the circuit.

The hydraulic circuit with the above-described arrangement according to the invention operates in the manner as follows.

In an excavating operation where the movements of the bucket 4 of the hydraulic shovel are not largely restricted by the working space and finish dimensions, generally the bladed end of the bucket 4 is put against the object to be worked, with the cylinders 6 and 7 in contracted state, and then the cylinders 6 and 7 are extended against an excavation resistance for an excavating action. Therefore, taking the cylinder 6 for the arm 3 as an example, a positive and relatively high pressure prevails in the head-side oil chamber 6*a* of the cylinder constantly during the operation, and accordingly the pressure detector 18 detects this pressure and sends out a corresponding signal to the arithmetic device 27, which applies its output signal to the signal receiving portion of the electromagnetic proportional regulator valve 17. In this instance, it is arranged such that the signal which is applied to the pilot oil chamber 15 from the signalling means 16 through the conduit 23 will not act to push back toward the neutral position the spool of the hydraulic change-over valve 10 switched to the position B. It follows that, as the cylinder 6 is extended when the hydraulic change-over valve 10 is in the position B, the return oil from the rod-side oil chamber 6b flows back to the tank 21 through the valve 10 in the position B without meeting any resistance. Similarly, as the cylinder 6 is conversely contracted with the hydraulic change-over valve 10 in the position A, no resistance is imposed to permit a quick and strong contracting action of the cylinder 6.

Figure 4:
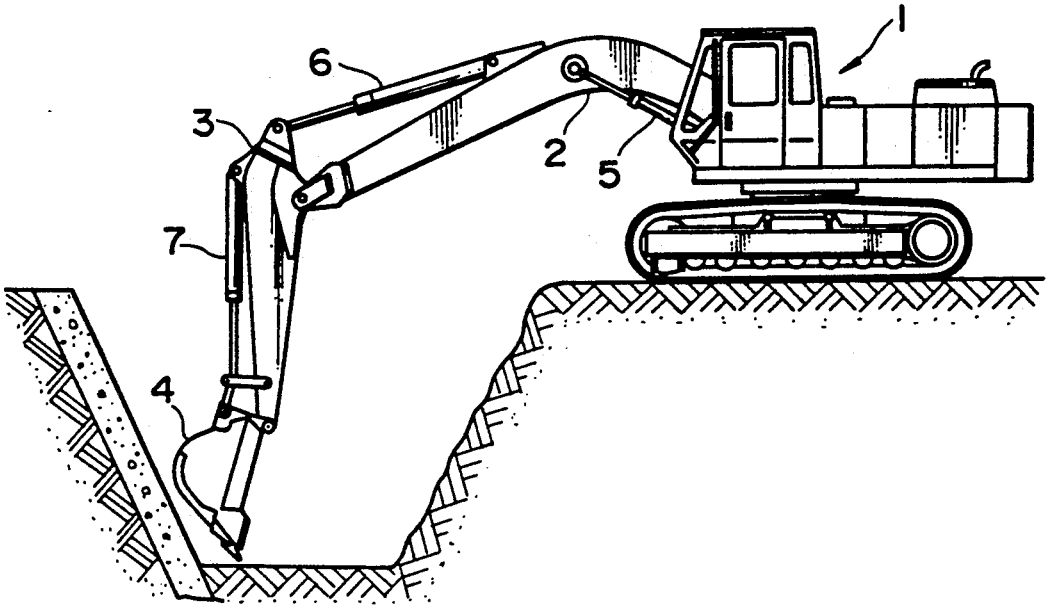
FIG. 4 is a diagrammatic side view of a hydraulic power shovel in excavating operation.

Nextly, when performing a job as shown in FIG. 4, it is the general practice to lower the rotational speed of the engine and to lower the bucket 4 carefully from above, starting excavation by abutting the bladed end of the bucket against the object to be removed. In this instance, depending upon the situation created by the discharge oil pressure of the hydraulic pump 8 and the weights and postures of the arm 3, bucket 4 and bucket cylinder 7, the pressure in the head-side oil chamber 6a normally tends to drop abruptly to develop cavitation. However, this variation in pressure is detected by the pressure detector 18, which sends signals sequentially to the arithmetic device 27. The arithmetic device 27 produces a signal of returning the spool of the hydraulic change-over valve 10 in the position B toward its neutral position and supplies the signal to the signal receiving portion of the electromagnetic proportional pressure regulator valve 17. Consequently, the return oil from the rod-side oil chamber 6b, which flows to the tank 21 through the conduit 19 and hydraulic change-over valve 10, meets a resistance as it flows through the port a. Thus, there is no possibility of the cavitation being caused by development of vacuum pressure in the head-side oil chamber 6a as a result of preceding extension of the cylinder 6 under the weights of the working components. Besides, in a case where a heavier hydraulic breaker or piling machine is mounted in place of the bucket 4 or in a case where an arm longer than normal dimensions is used, a greater extending force acts on the cylinder due to the increased weight of the arm, making the head-side oil chamber 6a more susceptible to cavitation. However, in the above-described embodiment of the invention, the flow of the return oil from the rod-side oil chamber 6b is restricted at the port a to cope automatically with various working conditions for cavitation-free operations, moving the cylinder 6 at a speed commensurate with the inflow rate of the pressurized oil to the head-side oil chamber 6a.

Figure 2:
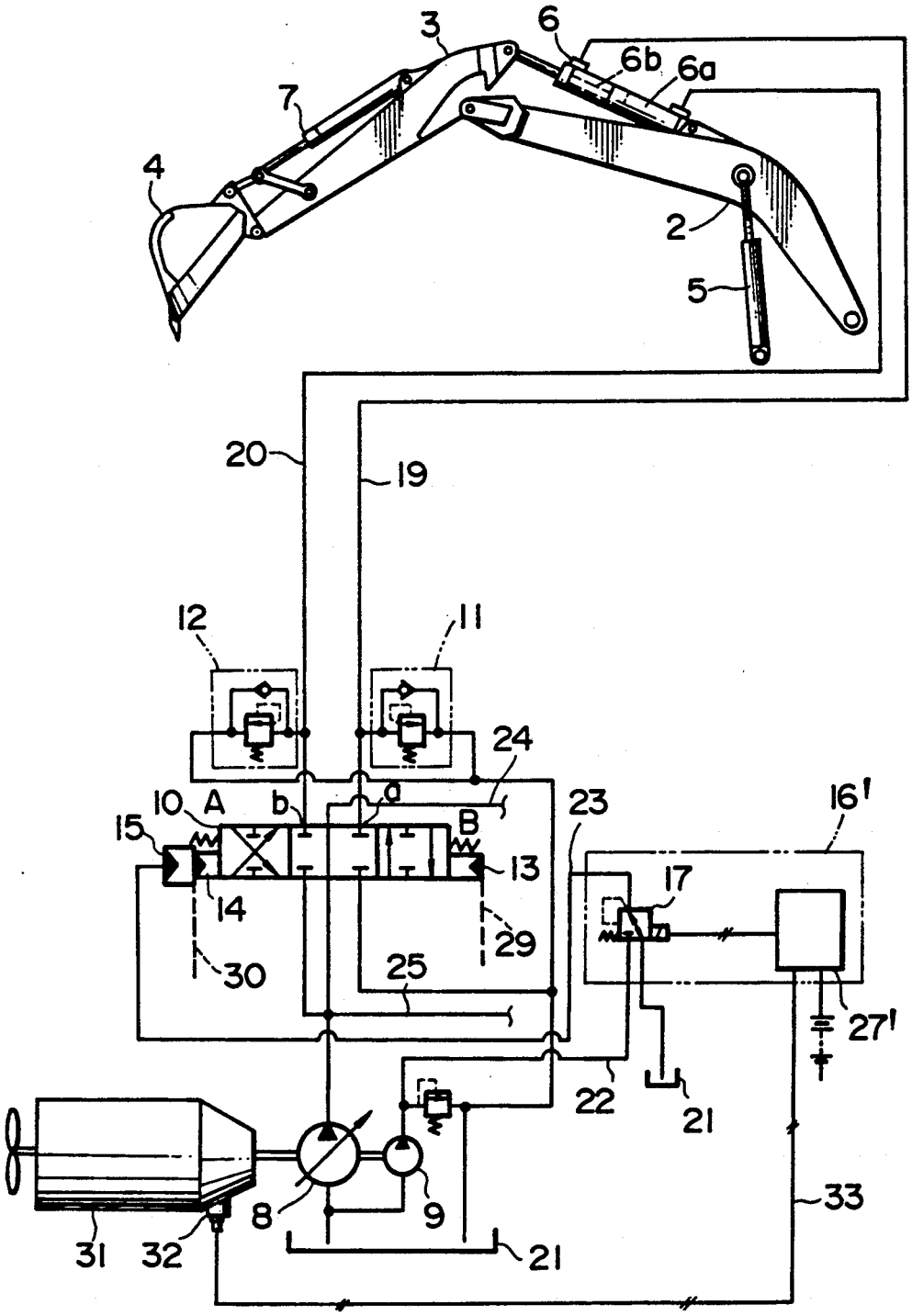
FIG. 2 is a view similar to FIG. 1 but showing a second embodiment of the invention.

Referring now to FIG. 2, there is diagrammatically shown major portions of the electro-hydraulic system in the second embodiment of the invention, which mainly differs from the first embodiment in which cavitation in the head-side oil chamber 6a of the cylinder 6 is prevented by an automatic control directly measuring the pressure in that chamber. In the second embodiment, the factor which will lead to cavitation is detected by a sensor, and the results of detection are administered by an arithmetic device 27'.

More specifically, indicated at 32 is an engine speed sensor which detects the rotational speed of an engine 31, serving as a detection means from which one can indirectly know the amount of pressurized oil which may be supplied to the oil chamber of the cylinder 6. Namely, this engine speed sensor 32 forms a detector for the cause of cavitation, and sends its output signal to the arithmetic device 27'. The lower the signal of the rotational speed from the speed sensor 32, the closer the spool of the hydraulic change-over valve 10 is pulled to its neutral position by the electromagnetic proportional regulator valve 17 according to instructions from the arithmetic device 27'.

Accordingly, in operation, the spool of the hydraulic change-over valve 10 is automatically moved to an optimum position with an open area which equalizes the amount of discharge oil of the hydraulic pump with the speed at which the cylinder is extended by the weights of the working components.

In the foregoing first and second embodiments of the invention, hydraulic and electromagnetic proportional regulator valves are used as a signalling medium and as a component for pulling back the spool of the hydraulic change-over valve 10, but it is to be understood that the invention is not restricted to these particular examples. The same object can be attained by arranging the signalling means 16 or 16' to produce a signal in proportion or in inverse proportion to input signals from various sensor means to pull back the spool of the hydraulic change-over valve 10 toward its neutral position. For this purpose, pneumatic or electric media or other instruments may be used in suitable combinations if desired.

Further, although the foregoing description explained prevention of cavitation in the head-side oil chamber 6a of the arm cylinder 6 alone, it is of course possible to apply a similar arrangement for prevention of cavitation in the rod-side oil chamber of the bucket cylinder or boom cylinder selectively or in a suitable combination depending upon the working condition, kinds of the working components and working postures.

It will be appreciated from the foregoing description that, by incorporating the hydraulic circuit of the invention into a hydraulic operating circuit for a cylinder which drives a working component, the return oil from an oil chamber of the cylinder is automatically throttled at a port of the hydraulic change-over valve even when the working component is replaced or when the work involves operations of different levels in fineness or in different postures, preventing extension or contraction of the cylinder from preceding the amount of oil supply and thus precluding the occurrence of cavitation and dangerous movements in operation to ensure efficient and accurate operations.

What is claimed is:

1. A hydraulic operating circuit of a power shovel including a hydraulic cylinder for driving a working component, comprising:

a hydraulic change-over valve having a spool moving from a neutral position to forward and reverse directions for selectively supplying said cylinder with a discharge oil pressure of a hydraulic pump driven from an engine;

a pair of first signal receiving portions provided on said hydraulic change-over valve and comprising means for moving said spool in the forward and reverse directions away from a neutral position, respectively, and a second signal receiving portion provided on said hydraulic change-over valve and comprising means for pulling back said spool toward said neutral position;

a pressure detector means adapted to produce a signal commensurate with the pressure in an oil chamber of said cylinder where a vacuum pressure is developed by the weight of said working component;

a signal producing means for producing a signal for pulling back said spool toward said neutral position in response to a detection of a vacuum pressure in said cylinder by said pressure detector means; and signal supplying means for supplying said signal from said signal producing means to said second signal receiving portion of said hydraulic change-over valve.

2. A hydraulic circuit as defined in claim 1, wherein said pressure detector means comprises a pressure detector fluidically communicating with the pressure in said oil chamber.

3. A hydraulic circuit as defined in claim 1 wherein said signal from said pressure detector means and said signal producing means are electrical signals.

4. A hydraulic circuit as defined in claim 3 wherein said signal producing means comprises an arithmetic device.

5. A hydraulic circuit as defined in claim 4 wherein said signal supplying means comprises an electromagnetic pressure regulator valve.

6. A hydraulic circuit as defined in claim 3 wherein said signal supplying means comprises an electromagnetic pressure regulator valve.

* * * * *